US005847496A

United States Patent [19]

Nakamoto et al.

[11] Patent Number: 5,847,496

[45] Date of Patent: Dec. 8, 1998

[54] FIELD EMISSION DEVICE INCLUDING A RESISTIVE LAYER

[75] Inventors: Masayuki Nakamoto; Tomio Ono, both of Kanagawa-ken, Japan

[73] Assignee: Kabushiki Kaisha Toshiba, Kawasaki, Japan

[21] Appl. No.: 906,334

[22] Filed: Aug. 5, 1997

Related U.S. Application Data

[63] Continuation of Ser. No. 404,268, Mar. 14, 1995, abandoned.

[30] Foreign Application Priority Data

Mar. 15, 1994 [JP] Japan ..... 6-069887

[51] Int. Cl.[6] ..... H01J 1/30; H01J 19/24

[52] U.S. Cl. ..... 313/336; 313/309; 313/456

[58] Field of Search ..... 313/336, 309, 313/351, 496, 497, 308; 445/50, 24

[56] References Cited

U.S. PATENT DOCUMENTS

| | | | |
|---|---|---|---|
| 2,662,957 | 12/1953 | Eisler | 427/102 |
| 4,307,507 | 12/1981 | Gray et al. | 313/309 |
| 4,940,916 | 7/1990 | Borel et al. | 313/306 |
| 5,038,070 | 8/1991 | Bardai et al. | 313/309 |
| 5,063,327 | 11/1991 | Brodie et al. | 313/309 |
| 5,312,514 | 5/1994 | Kumar | 445/51 |
| 5,371,431 | 12/1994 | Jones et al. | 313/309 |
| 5,397,957 | 3/1995 | Zimmerman | 313/309 |
| 5,401,676 | 3/1995 | Lee | 445/50 |
| 5,451,830 | 9/1995 | Huang | 313/309 |
| 5,483,118 | 1/1996 | Nakamoto et al. | 313/309 |
| 5,499,938 | 3/1996 | Nakamoto et al. | 445/50 |
| 5,525,264 | 6/1996 | Cronin et al. | 427/108 |
| 5,628,659 | 5/1997 | Xie et al. | 445/50 |

OTHER PUBLICATIONS

"Physical Properties of Thin–Film Field Emission Cathodes With Molybdenum Cones," C.A. Spindt et al., Journal of Applied Physics, vol. 47, No. 12, Dec. 1976, pp. 5248–5263.

M. Sokolich et al "Field Emmission From Submicron Emitter Arrays" 1990, pp. 159–162 (no month).

C.A. Spindt, "Field–Emitter Arrays for Vacuum Microelectronics" 1991, pp. 2355–2363 (Oct.).

CRC Handbook of Chemistry & Physics, pp. D–54 & F118 (1978–1979) (no month).

*Primary Examiner*—Sandra L. O'Shea
*Assistant Examiner*—Michael Day
*Attorney, Agent, or Firm*—Finnegan, Henderson, Farabow, Garrett & Dunner, L.L.P.

[57] ABSTRACT

A microelectronic field emission device includes a core layer (16) having at least one outward protuberance on a top surface of the core layer, and an emitter layer (15) formed on the core layer to cover at least a top portion of the outward protuberance, the material of the core layer having a larger electrical resistance than the material of the emitter layer, wherein the top portion of the outward protuberance culminates to a tip and a portion of the emitter layer (15) formed on the protuberance culminates to a tip. The microelectronic device may further include a substrate (19), a conductive layer (17), an anode electrode (53) including a phosphor layer, and a gate electrode (21) having an opening thereby exposing the tip of the emitter layer.

16 Claims, 12 Drawing Sheets

FIELD EMISSION DEVICE INCLUDING A RESISTIVE LAYER

This application is a continuation, of application Ser. No. 08/404,268, filed Mar. 14, 1995, now abandoned.

BACKGROUND OF THE INVENTION

1. Field of the Invention

This invention relates to vacuum microelectronic devices. More particularly, the invention relates to micro vacuum tubes having cold emitters and methods of producing such cold emitters and micro vacuum tubes.

2. Description of the Related Art

It has been proposed to produce a micro vacuum tube having a field-emission type cathode, i.e., a cold emitter. For example, C. A. Spindt et al., J. Appl. Phys., vol. 47, 5248 (1976) discloses a method, known as "rotation vacuum deposition", for producing a cold emitter. Under this method, a $SiO_2$ layer disposed on a Si substrate has a pinhole exposing a surface of the Si substrate. A gate layer also disposed on the $SiO_2$ layer contains a pinhole. A Mo layer is deposited on the Si substrate, which is rotated during deposition. As a result, a cone-shaped cold emitter is formed directly on the Si substrate at the pinhole.

This method has drawbacks. For example, it is difficult to form cold emitters having the same shape and height using this method. Each cold emitter may have a different distance from an anode disposed above the cold emitters. Also, each cold emitter may have a different distance from the gate electrode. As a result, each emitter possesses different electrical properties, e.g., a threshold voltage of emission, or resistance due to the variation in distances. When plural cold emitters are used in parallel connection, current will be concentrated in, for example, the cold emitter having the lowest electric resistance, eventually causing damage to that cold emitter.

Moreover, it is difficult to make a cold emitter having a sharp tip using this method. Therefore, a micro vacuum tube manufactured using this method exhibits poor field emission efficiency.

Another reference, U.S. Pat. No. 4,940,916, discloses a micro vacuum tube and its application for display means. The micro vacuum tube provides cold emitters produced by the method of rotation vacuum deposition. Plural cold emitters are formed on a continuous resistive layer. The resistive layer is formed on an electrically conductive layer connected to a power source and formed on a substrate. Since the resistive layer is inserted between each cold emitter and electrically conductive layer, the resistive layer averages currents flowing in each cold emitter.

However, the problems of forming plural cold emitters with the same shape, the same height, the same distance from the gate electrode, and a sharp tip still remain.

U.S. Pat. No. 4,307,507 discloses another method for producing a cold emitter. This method uses a Si substrate as a mold. The Si substrate is etched by anisotropic etching so as to have pyramid-shape pits. A thick film of polysilicon is filled in the pits and the surface of the Si substrate. After that, the Si substrate is removed by etching. As a result, a polysilicon substrate providing pyramid-shaped cold emitters is obtained. An insulator layer and a gate electrode are then provided on the pyramid-shaped cold emitters.

In accordance with the above-described method, cold emitters must be made of materials having small inner stress, such as polysilicon, because it is difficult to form thick films with a material having large inner stress. As a result, it is difficult to obtain a cold emitter using a material having a low working function, i.e., a material easy to emit an electron.

Furthermore, a large force might be applied between a cold emitter and a gate electrode, requiring the cold emitter to have sufficient strength so as to maintain the distance between the cold emitter and the gate electrode to avoid concentration current. However, it is difficult to obtain a cold emitter made of a material having such a high strength.

SUMMARY OF THE INVENTION

Accordingly, the present invention is directed to a micro vacuum tube that substantially obviates one or more of the problems due to limitations and disadvantages of the related art.

One object of the present invention is to provide a micro vacuum tube including a cold emitter composed of a material having large inner stress.

Another object of the present invention is to provide a micro vacuum tube including a cold emitter having sufficient strength.

Still another object of the present invention is to provide a micro vacuum tube including a cold emitter having a sharp tip.

Yet another object of the present invention is to provide a micro vacuum tube including cold emitters having substantially the same shape.

A further object of the present invention is to provide a micro vacuum tube including cold emitters having a resistive layer which can average the currents flowing in each cold emitter.

To achieve these and other advantages and in accordance with the purpose of the invention, as embodied and broadly described herein, one aspect of the invention includes a vacuum microelectronic device comprising a core layer having at least one outward protuberance on a top surface of the core layer, and an emitter layer formed on the core layer, wherein a portion of the emitter layer formed on the protuberance culminates at a tip.

In another aspect, the invention includes a method for producing a vacuum microelectronic device, comprising the steps of: forming a dent in one surface of a mold substrate; depositing an emitter layer on the one surface; depositing a core layer on the emitter layer; and removing the mold substrate at the dent by etching so as to obtain a protuberance composed of the emitter layer and the core layer covered with the emitter layer.

BRIEF DESCRIPTION OF THE DRAWINGS

The accompanying drawings, which are incorporated in and constitute a part of this specification, illustrate embodiments of the invention and together with the description, serve to explain the objects, advantages, and principles of the invention.

DETAILED DESCRIPTION

Figure 1A:
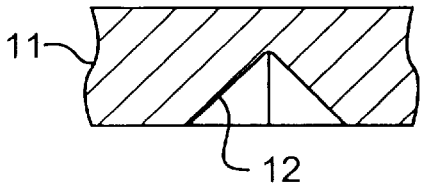
FIGS. 1(*a*)–(*h*) are cross-sectional views of a cold emitter at different phases of a process for producing a cold emitter in accordance with a first embodiment of the present invention.
Figure 1B:
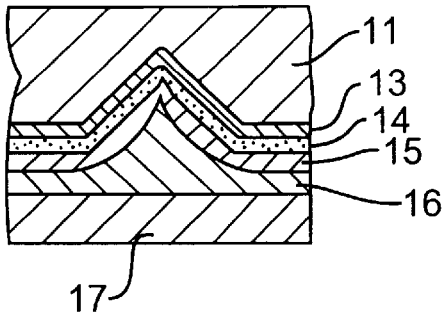
Figure 1C:
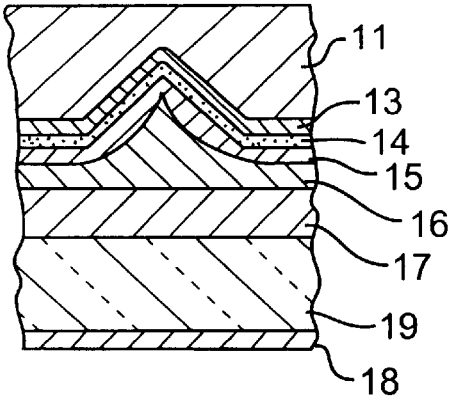
Figure 1D:
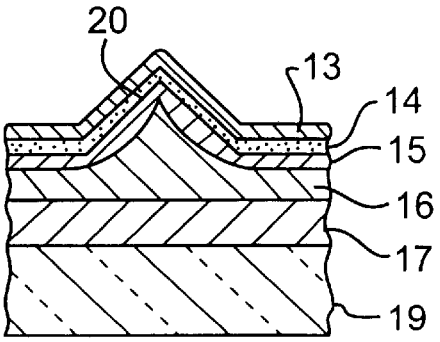
Figure 1E:
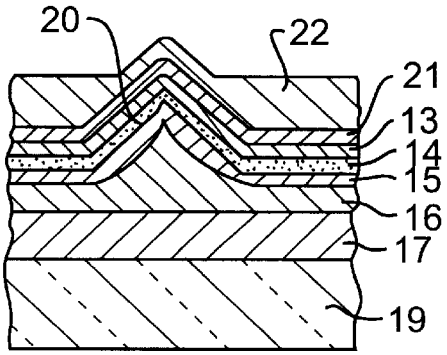
Figure 1F:
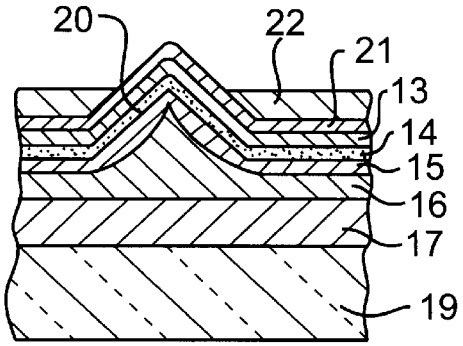
Figure 1G:
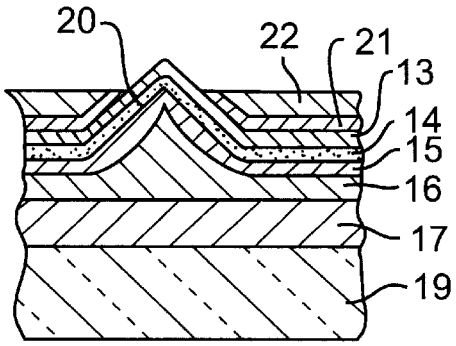
Figure 1H:
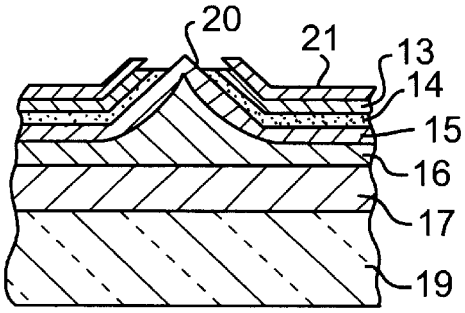

FIGS. 1(*a*)–(*h*) are cross-sectional views of a cold emitter at different phases of a process for producing a cold emitter composing a micro vacuum tube in accordance with a first embodiment of the present invention.

A substrate 11 made of, for example, Si, has a dent 12, which may be produced by etching. Substrate 11 is preferably a p-type Si monocrystal having a crystal direction of (100). An oxide layer is formed on the substrate by thermal dry oxidation, where the oxide layer has a thickness of about 0.1 $\mu$m. Using a photo-etching process involving, for example, a mixture of $NH_4F$ and HF, an opening is provided in the oxide layer. Then, by anisotropic etching (e.g., using an aqueous solution containing 30 wt % of KOH) a pyramid-shaped dent 12 can be obtained corresponding to the opening. Subsequently, the remaining oxide layer is removed (FIG. 1(*a*)) by etching, for example, with an aqueous solution containing 30 wt % of KOH. When the opening is a 0.8 $\mu$m square, a depth of dent 12 would be about 0.56 $\mu$m.

Substrate 11 preferably provides plural dents 12, although FIG. 1(*a*) shows only one dent 12. Anisotropic etching is effective to obtain a sharp tip on dent 12, and, further, to obtain plural dents 12 having the same shape. However, other methods besides anisotropic etching can be used to produce dent 12 in accordance with the invention.

A doped layer 13 having the thickness of about 100 nm is formed on the surface of substrate 11, for example, by thermal diffusion. Since doped layer 13 will be used as an etching stopper, the thickness is preferably about 20 nm or more, and a doping concentration is preferably about $3\times10^{19}cm^{-3}$ or more. Dopants that cause a doped layer to have a different etching rate from substrate 11, such as, B (boron), can be used.

An insulator layer 14 is formed on doped layer 13, for example, by thermal dry oxidation. Also, insulator layer 14 will be used as an etching stopper. Therefore, the thickness is preferably about 50 nm or more (e.g., 100 nm). If the insulator layer 14 can be sufficiently used as the etching stopper, the doped layer 13 could be eliminated.

Insulator layer 14 may be formed by other methods such as chemical vapor deposition (CVD). However, thermal oxidation is more preferable than CVD or other methods. A thickness of insulator layer 14 at sides of dent 12 is thicker than at the tip with thermal oxidation so as to make a sharper tip. Therefore, thermal oxidation is effective to obtain a sharp tip. Further, even if each depth of plural dents 12 is a little different, thermal oxidation can relieve the difference.

An emitter layer 15 is formed on insulator layer 14, for example, by sputtering. Emitter layer 15 provides a dimple corresponding to dent 12.

Emitter layer 15 is preferably composed of a material which is chemically and physically stable, and has a small work function, e.g., W, Mo, Ta, or $LaB_6$. The thickness is preferably about 20 nm or more (e.g., 200 nm). Excessive thickness causes emitter layer 15 to peel off of mold 11, if the material has a large inner stress.

A core layer 16 is formed on emitter layer 15 so as to fill the dimple of emitter layer and make a flat surface, for example, by sputtering. Emitter layer 15 and core layer 16 will compose a cold emitter.

Core layer 16 is preferably composed of a material having an inner stress smaller than that of a material composing emitter layer 15, such as Al or polysilicon. Therefore, the core layer includes a material stronger than a material of the emitter layer. Further, when a cold emitter has a smaller electric resistance, core layer 16 is preferably composed of a material having a smaller electric resistance than that of a material composing emitter layer 15. Also, when a large electric resistance is required, core layer 16 is preferably composed of a material having a larger electric resistance than that of a material composing emitter layer 15, such as Ru, C, Si, $In_2O_3$, $SnO_2$, or ZnO.

Moreover, if core layer 16 is used as a ballast resistance layer, the emitter layer 15 is preferably divided into cold emitters or small groups of cold emitters.

A conductive layer 17 (e.g., about 1 $\mu$m) is formed on core layer 16 (FIG. 1(*b*)). Conductive layer 17 is made of a material having a lower electric resistance than core layer 16, such as ITO, Cu, Ag, Au, or Al. When core layer 16 and emitter layer 15 have a sufficiently low electric resistance, conductive layer 17 is not necessary.

A structural substrate 19 providing a back coating conductive layer 18 on one side (e.g., about 0.4 $\mu$m of Al), is joined with conductive layer 17 at the other side (FIG. 1(*c*)). For example, "Pyrex" glass having a thickness of about 1 mm can be used. Structural substrate 19 may be composed of glasses or ceramics, which are insulators.

When an electrostatic bonding method is used to join structural substrate 19 with conductive layer 17, structural substrate 19 is required to provide back coating conductive layer 18 so as to apply a voltage between a back coating conductive layer 18 and conductive layer 17. After bonding, back coating conductive layer 18 may be removed by, for example, a mixture solution of $HNO_3$, $CH_3COOH$, and HF. However, back coating layer 18 could be used as a shield against electromagnetic noises.

Substrate 11 is removed so that doped layer 13 is exposed (FIG. 1(*d*)) by etching, for example, with a mixed aqueous solution of ethylen diamine, pyrocatechol, pyrazine, and water (=75 cc: 12 g:3 mg:10 cc). Doped layer 13 fills the role of an etching stopper so as to defend a tip of a cold emitter, i.e., the bottom of dent 12 against etching. As a result, a protuberance 20, i.e., a cold emitter, is obtained. Since substrate 11 is used as a mold, substrate 11 can be called a mold substrate.

Protuberance 20 is composed of emitter layer 15 deposited on core layer 16 and has a pyramid-shape. Further, protuberance 20 is coated with insulator layer 14 and doped layer 13.

When a gate electrode is not provided in connection with the cold emitter, doped layer 13 and insulator layer 12 may be removed to obtain an uncovered surface of cold emitter. However, a gate electrode could be provided in connection with the cold emitter by the following steps.

A gate electrode layer 21 (e.g., about 200 nm of W) is deposited on doped layer 13, for example, by sputtering. Gate electrode layer 21, doped layer 13, and insulator layer 12 at a top of protuberance 20 are removed so that emitter layer 15 appears at the top of protuberance 20.

For example, a photoresist layer 22 having a thickness of about 200 nm is coated on gate electrode layer 21 (FIG. 1(*e*)). Then, photoresist layer 22 is thinned by etching (e.g., dry etching with oxygen plasma) so that insulator layer 12 and doped layer 13 at the top of protuberance 20 appear around approximately a 400 nm square (FIG. 1(*f*)).

Then gate electrode layer 21 at the top of protuberance 20 is removed by etching, for example, reactive ion etching or wet-etching (FIG. 1(*g*)). Doped layer 13 and insulator layer 12 at the top of protuberance 20 are removed by etching (e.g., with a mixture of $NH_4F$ and HF) so that a tip of protuberance of emitter layer 15 are exposed (FIG. 1(*h*)), then photoresist layer 22 is removed.

Figure 2:
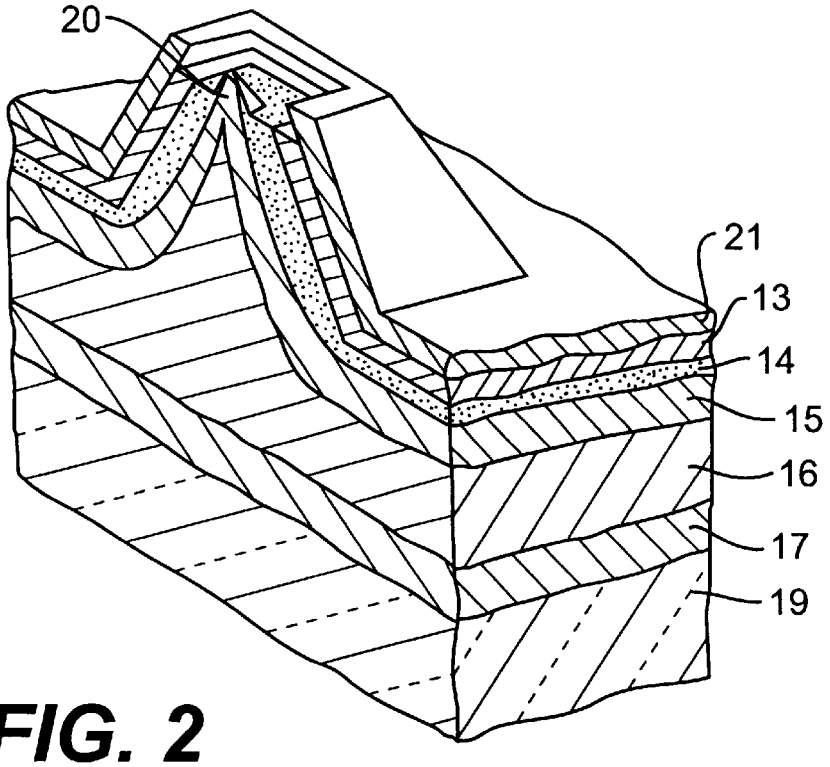
FIG. 2 is a cross-sectional perspective view of a cold emitter in accordance with the first embodiment of the invention.

The exposed emitter layer 15 is surrounded by gate electrode layer 21. FIG. 2 shows a partially cutaway perspective view of FIG. 1(*h*). Therefore, a cold emitter providing a gate electrode is obtained.

Figure 3:
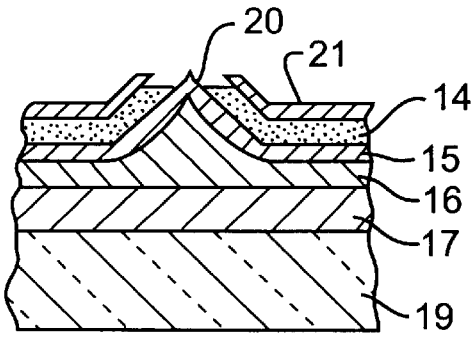
FIG. 3 is a cross-sectional view of a cold emitter of a micro vacuum tube in accordance with a second embodiment of the present invention.

Since insulator layer 14 could also fill the role of an etching stopper, doped layer 13 can be omitted. FIG. 3 shows a cross-sectional view of a cold emitter of the present invention which does not provide doped layer 13. Except for doped layer 13, the cold emitter of FIG. 3 has the same structure of FIG. 1(*h*). Accordingly, the number of steps needed to produce a cold emitter of this embodiment can be reduced.

Further, when doped layer 13 has a sufficiently low electrical resistance, for example, about $10^{-4}$ ω. cm or less, or has a sufficiently high doping concentration, such as at least $10^{20}cm^{-3}$ or $10^{21}cm^{-3}$, doped layer 13 acts as a conductive layer and a gate electrode. In such a case, gate electrode layer 21 can be omitted.

Figure 4:
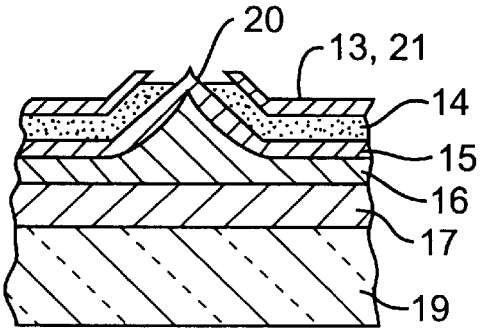
FIG. 4 is a cross-sectional view of a cold emitter of a micro vacuum tube in accordance with the second embodiment of the present invention.

FIG. 4 shows a cross-sectional view of a cold emitter of the second embodiment of the present invention. This cold emitter of FIG. 4 provides the same structure as the cold emitter shown in FIG. 1(*h*), except for gate electrode layer 21. In this embodiment, the number of steps needed to produce this cold emitter can be reduced from the number of steps needed to produce the cold emitter shown in FIG. 1(*h*). Furthermore, a gate electrode can be more accurately disposed closer to a cold emitter.

The above-mentioned cold emitters can be used in a micro vacuum tube with an anode electrode disposed above the cold emitters in a vacuum.

Figure 5:
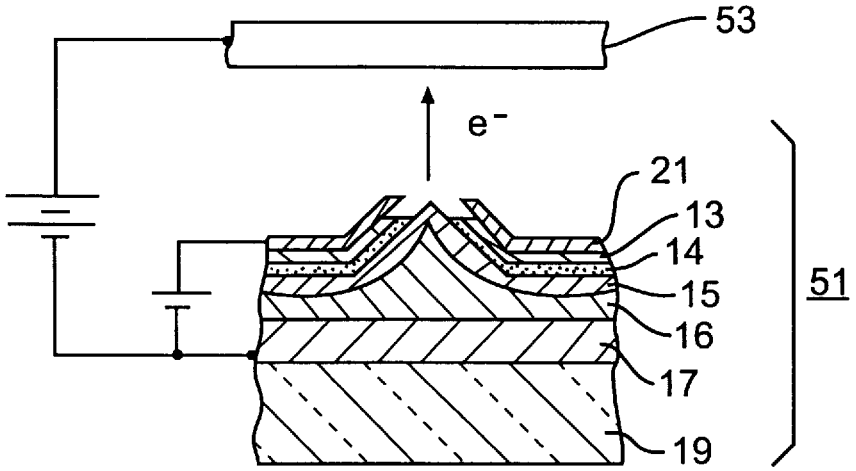
FIG. 5 is a conceptual view of a micro vacuum tube in accordance with a third embodiment of the present invention.

FIG. 5 shows a conceptual view of a micro vacuum tube of the third embodiment of the present invention. Cold emitter 51 providing gate electrode 21 is disposed above an anode electrode 53 at a distance between, for example, about 5 μm and 200 μm so electrons are emitted from the tip of the protuberance to anode electrode 53 with a bias voltage between conductive layer 17 and anode electrode 53, and between conductive layer 17 and gate electrode layer 21. This micro vacuum tube serves as a triode device.

Figure 6:
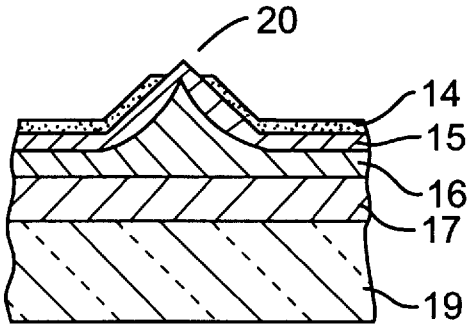
FIG. 6 is a cross-sectional view of a cold emitter of a micro vacuum tube in accordance with a fourth embodiment of the present invention.

A cold emitter according to the present invention can also be applied to a diode. In a diode, gate electrode 21 is not required. FIG. 6 shows a cross-sectional view of a cold emitter according to the fourth embodiment of the present invention, wherein gate electrode layer 21 and doped layer 13 are not provided. Insulator layer 14 can also be eliminated. Except for gate electrode layer 21, doped layer 13 and insulator layer 14, the cold emitter of FIG. 6 has the same structure as the emitter of FIG. 1(*h*).

A micro vacuum tube of the present invention can be used as a current control device with high speed switching or with a large current flow, since electrons flow in a vacuum. The large current control device preferably provides plural cold emitters.

Further, a micro vacuum tube of the present invention can be used as a display. In such a case, for example, a phosphor layer is provided on an anode electrode to emit light.

Plural cold emitters may be controlled together by either turning all of the emitters on or off. Also, plural cold emitters may be individually controlled by controlling individual emitters or groups of emitters.

Figure 7:
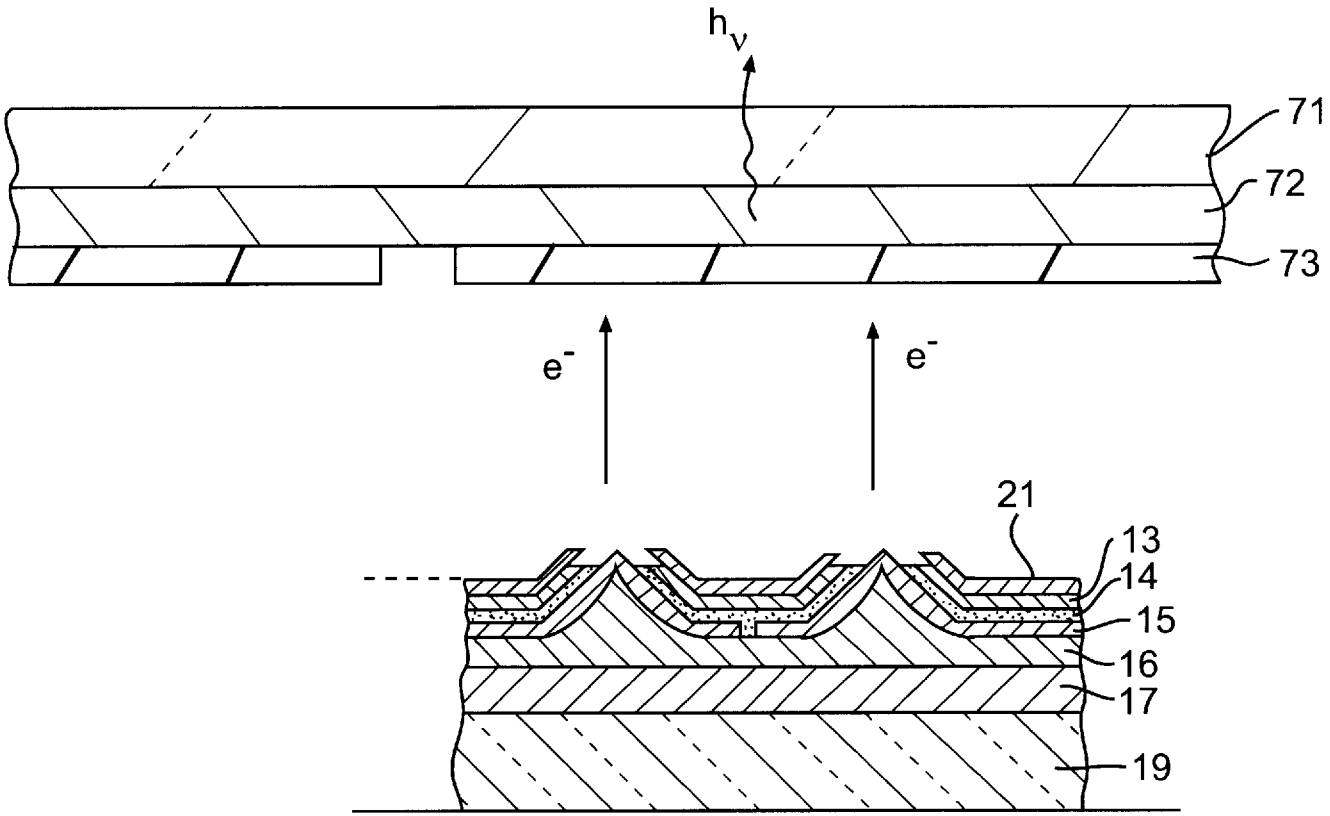
FIG. 7 is a conceptual view of a display using a micro vacuum tube in accordance a fifth embodiment of the present invention.

FIG. 7 shows a conceptual view of a display according to the fifth embodiment of the present invention. An anode plate 71, which is made of a transparent material such as glass, an anode electrode layer 72 and a phosphor layer 73 are disposed above cold emitters of the same structure shown in FIG. 1(*h*). Plural emitters may be monolithic corresponding to a single color. Plural emitters of one unit are turned on together by supplying a bias voltage between gate electrodes 21, and turned off together by stopping supply of the bias voltage. Current supply lines or signal lines (not shown) can be provided by, for example, semiconductor processes. Moreover, if core layer 16 is used as a ballast resistance layer, the emitter layer 15 is preferably divided into individual cold emitters or groups of cold emitters.

Figure 8:
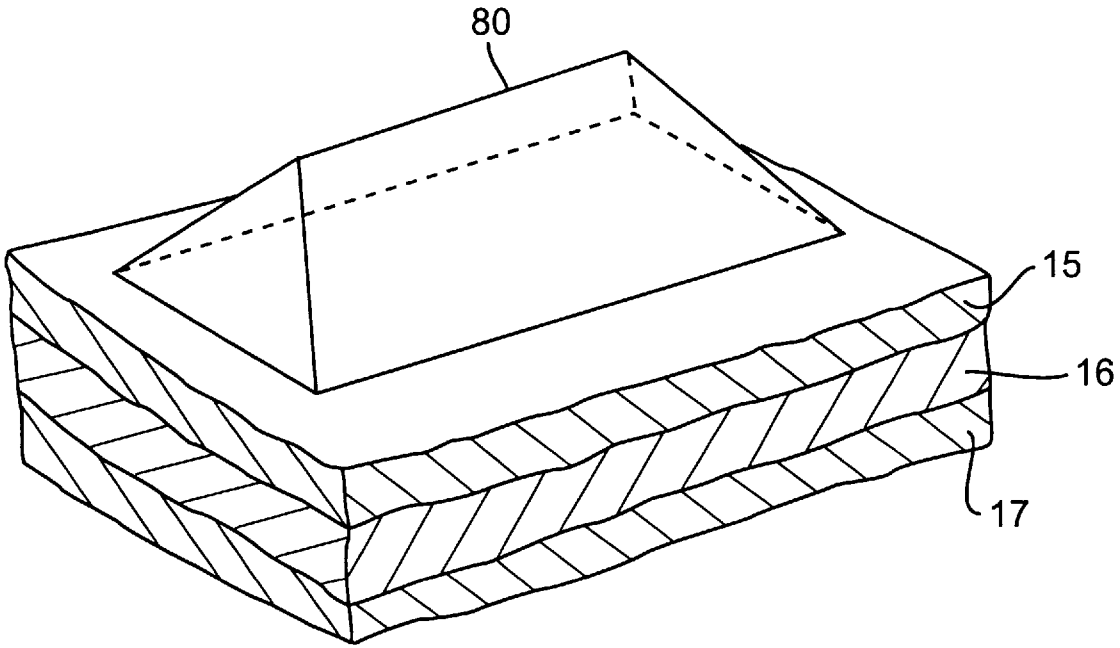
FIG. 8 is a perspective view of a cold emitter of a micro vacuum tube in accordance with a sixth embodiment of the present invention.
Figure 9A:
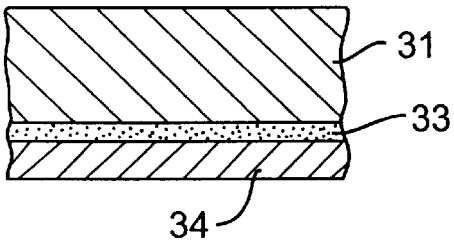
FIGS. 9(*a*)–(*i*) are cross-sectional views of a cold emitter at different phases of a process for producing a cold emitter of a micro vacuum tube in accordance with a seventh embodiment of the present invention.
Figure 9B:
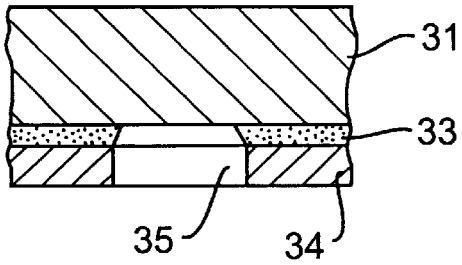
Figure 9C:
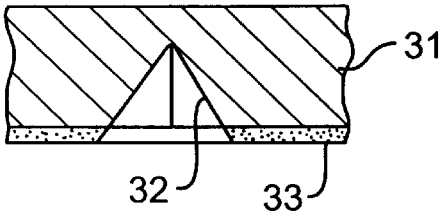
Figure 9D:
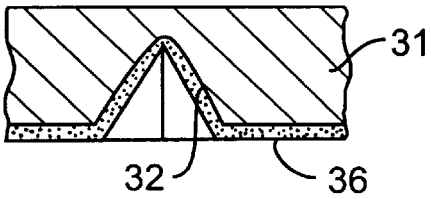
Figure 9E:
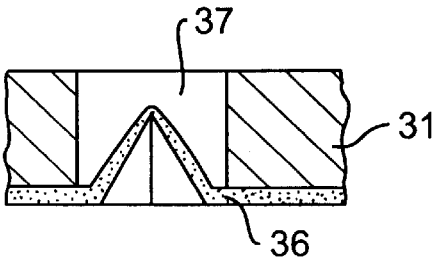
Figure 9F:
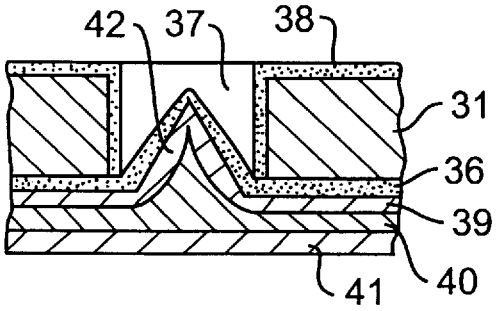
Figure 9G:
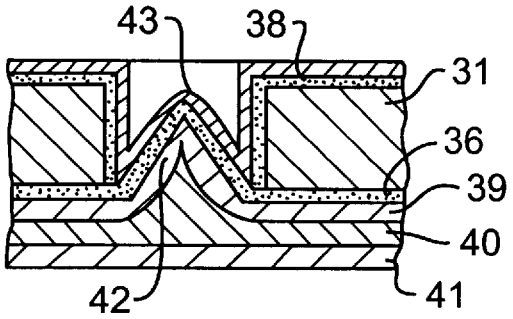
Figure 9H:
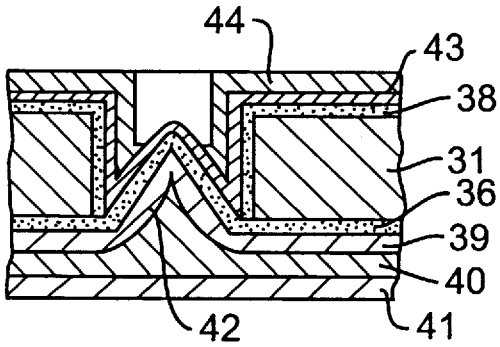
Figure 9I:
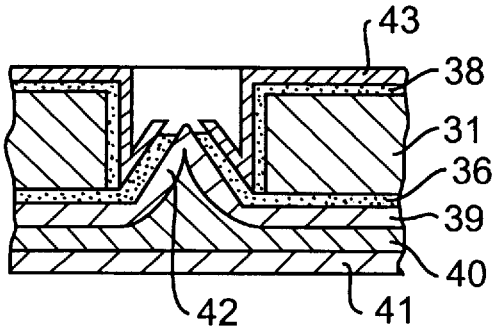

The cold emitter is not limited to a pyramid-shape. For example, a cold emitter of the present invention could have a roof-shape having a ridge 80 as shown in FIG. 8. The cold emitter in FIG. 8 would have a large current capacity. Such a cold emitter could be obtained by the same method of FIG. 1(*a*).

For example, as discussed above in FIG. 1(*a*), a pyramid-shaped dent 12 is obtained by using the oxide layer providing a square opening as a resist for anisotropic etching. If the opening is a rectangle, dent 12 would have the same shape as the protuberance in FIG. 8.

Also, in FIG. 1(*a*), protuberance 20 is composed of emitter layer 15, and core layer 16 coated with emitter layer 15. Therefore, it is possible to change materials between emitter layer 15 and core layer 16.

Most of the materials that readily emit electrons have large inner stress. Therefore, a thick film of the materials is difficult to obtain. However, according to the present invention, even if materials have large inner stress, since an emitter material could be disposed only at a surface of a protuberance, a cold emitter composed of the materials having a large inner stress could be produced. As a result, a micro vacuum tube can efficiently emit electrons.

Further, when an electric resistance of core layer 16 is larger than that of emitter layer 15, core layer 16 may fill a electric resistance to average currents flowing in each cold emitter. When a current is concentrated in one cold emitter, a bias voltage of that cold emitter would be reduced due to the electric resistance of the core layer. In this usage, the emitter layer 15 is preferably divided in each cold emitter or in small groups of cold emitters.

Furthermore, when a core layer is composed of hard materials, the distance between a tip of a cold emitter and a gate electrode can be maintained, if a large force is applied by an electric field.

Also, according to the method of the present invention, emitter materials can be selected from a wide variety of materials. Further, if plural cold emitters are provided, it is possible to produce the plural cold emitters having the same shape, since anisotropic etching can be used.

Moreover, while protuberance 20 has been described as having two layers, i.e., core layer 15 and emitter layer 16, three or more layers can be provided in protuberance 20 for example, by providing two or more layers of core layer 15.

Furthermore, a micro vacuum tube according to the present invention could provide two or more gate electrodes in a direction between an anode electrode and a cold emitter, such as a tetrode device or a pentode device.

The micro vacuum tube would be required to provide a spacer to maintain a distance between a cold emitter and an anode electrode. The spacer would be a frame or plural small beads like an LCD. However, the spacer can also be provided as one body.

FIGS. 9(*a*)–(*i*) are cross-sectional views of a cold emitter at different phases of a process for producing a cold emitter of a seventh embodiment of the present invention, including a spacer.

A Si substrate 31 having a dent 32 on one side is provided and can be obtained in the manner described above. An oxide layer 33 (e.g., about 100 nm) is formed on substrate 31 by a thermal dry oxidation and a photoresist 34 is formed on oxide layer 33 (FIG. 9(*a*)) by spin coating.

Using a photo-etching process employing a mixture of $NH_4F$ and HF, an opening 35, such as 1 $\mu$m square, is provided in oxide layer 33 (FIG. 9(*b*)). After that, by anisotropic etching with an aqueous solution containing 30 wt % of KOH, dent 32 can be obtained (FIG. 9(*c*)). When opening 35 is 1 $\mu$m square, the depth of dent 32 is about 710 nm. Oxide layer 33 is then removed. Substrate 31 preferably includes plural dents 32, although FIGS. 9(*a*)–(*i*) show only a single dent 32.

Substrate 31 is oxidized so as to form an insulator layer 36, which may be a 300 nm layer of $SiO_2$ on the surface of dent 32 (FIG. 9(*d*)). After that, substrate 31 is etched from the other side to make a hole 37 so that insulator layer 36 is exposed (FIG. 9(*e*)

Substrate 31 is oxidized so as to form an insulator layer 38 (e.g., 200 nm thick) on the surface providing hole 37. An emitter layer 39, which may be a 800 nm layer of W. a core layer 40, and a conductive layer 41 approximately 1 $\mu$m thick are sequentially formed on dent 32 (FIG. 9(*f*)). As a result, a protuberance 42 composed of core layer 40 coated with emitter layer 39 is obtained.

A gate electrode layer 43 that may be a 900 nm layer of W, is deposited on insulator layer 38 on the opposite side of dent 32 (FIG. 9(*g*)). A photoresist layer 44 is coated on gate electrode layer 43 and then an opening (e.g., 700 nm square) is formed in photoresist layer 44 so that the top of protuberance 42 is covered with insulator layer 36 and gate electrode layer 43 by etching (FIG. 9(*h*)).

Then gate electrode layer 43 at the top of protuberance 20 is removed by etching (FIG. 9(*i*)). As a result, a tip of protuberance 42 and a tip of emitter layer 39 are surrounded by gate electrode layer 43.

Figure 10:
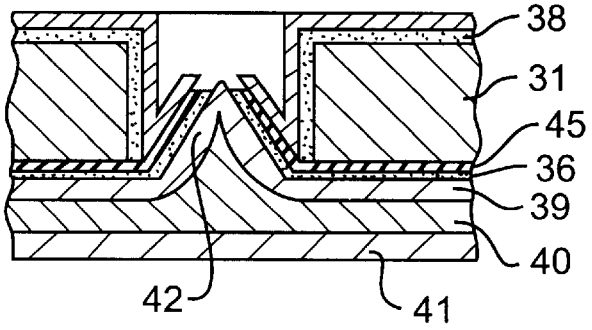
FIG. 10 is a cross-sectional view of a cold emitter of a micro vacuum tube in accordance with an eighth embodiment of the present invention.
Figure 11:
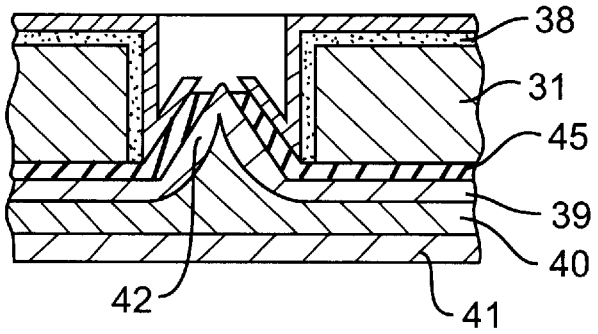
FIG. 11 is a cross-sectional view of a cold emitter of a micro vacuum tube in accordance with a ninth embodiment of the present invention.

A doped layer 45 can also be provided, as shown in FIG. 10. Also, gate electrode layer 43 could be replaced by doped layer 45, as shown in FIG. 11.

Figure 12:
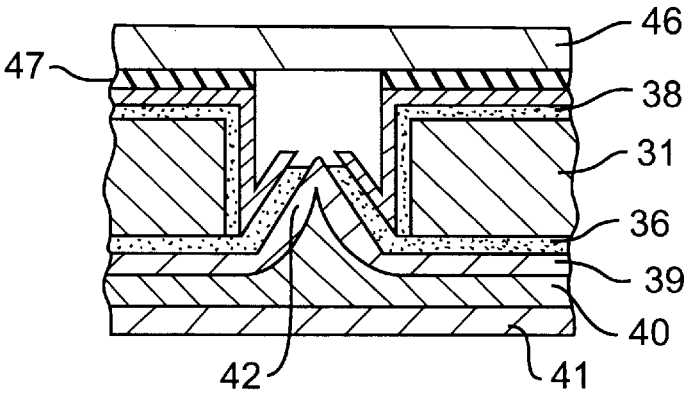
FIG. 12 is a conceptual view of a micro vacuum tube in accordance with a tenth embodiment of the present invention.

The remaining portions of substrate 31 can be used as a spacer to maintain a distance between cold emitter 42 and an anode electrode. FIG. 12 shows a micro vacuum tube using cold emitter of FIG. 9(*i*). An anode electrode plate 46 is disposed on substrate 31 to compose a micro vacuum tube with insulator layer 47.

Since substrate 31 remains, it may not be necessary to provide structural substrate 19 of FIG. 1(*h*). However, a structural substrate could be provided to strengthen a micro vacuum tube. Also, if core layer 40 has a sufficient thickness, core layer 40 could fill the role of a structural substrate.

An anode electrode could be also provided to a micro vacuum tube monolithically.

Figure 13A:
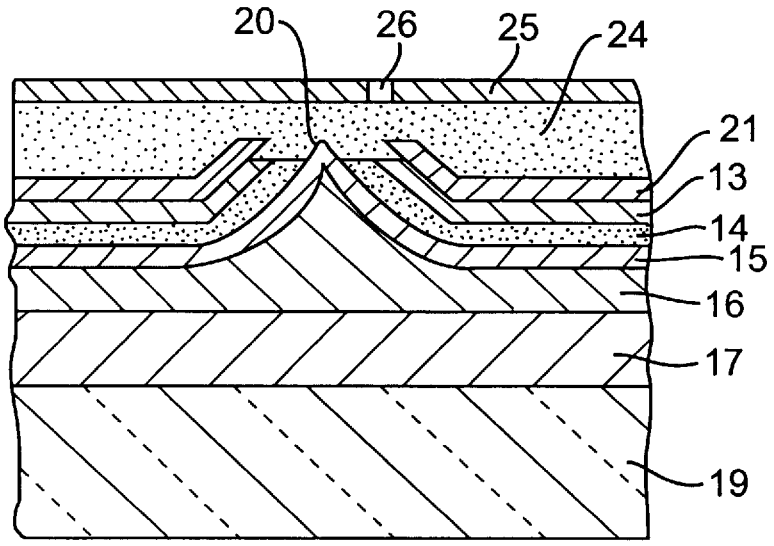
FIGS. 13(*a*) and (*b*) are cross-sectional views of a micro vacuum tube in accordance with an eleventh embodiment of the present invention.
Figure 13B:
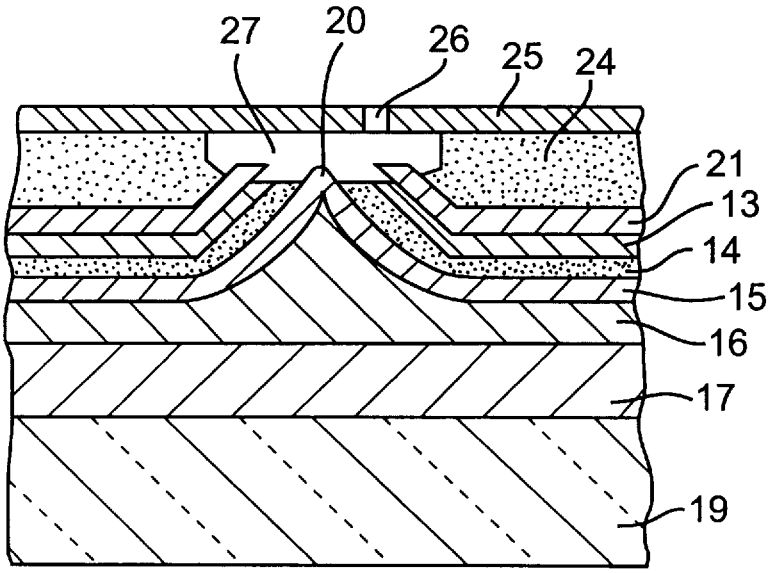

FIGS. 13(*a*) and (*b*) show cross-sectional views of a micro vacuum tube of another embodiment using the cold emitter of FIG. 1(*h*) according to the present invention. A cold emitter shown in FIG. 1(*h*) is used in this embodiment.

A removable insulator layer 24, such as a PSG (P-doped silicate glass), is deposited on gate electrode layer 21 and protuberance 20. To obtain a flat surface, after sputtering of removable insulator layer 24, removable insulator layer 45 is etched back. An anode electrode layer 25, such as W, Mo, or Ta, is deposited on removable insulator layer 24, for example, by sputtering.

Anode electrode layer 25 provides a throughhole 26 above protuberance 20 (FIG. 13(*a*)). Removal insulator layer 24 is partially removed through throughhole 26 so as to make a space 27 between anode electrode layer 25 and the tip of protuberance 20 (FIG. 13 (*b*)), for example, by etching with a mixture solution of $NH_4F$ and HF.

Figure 14:
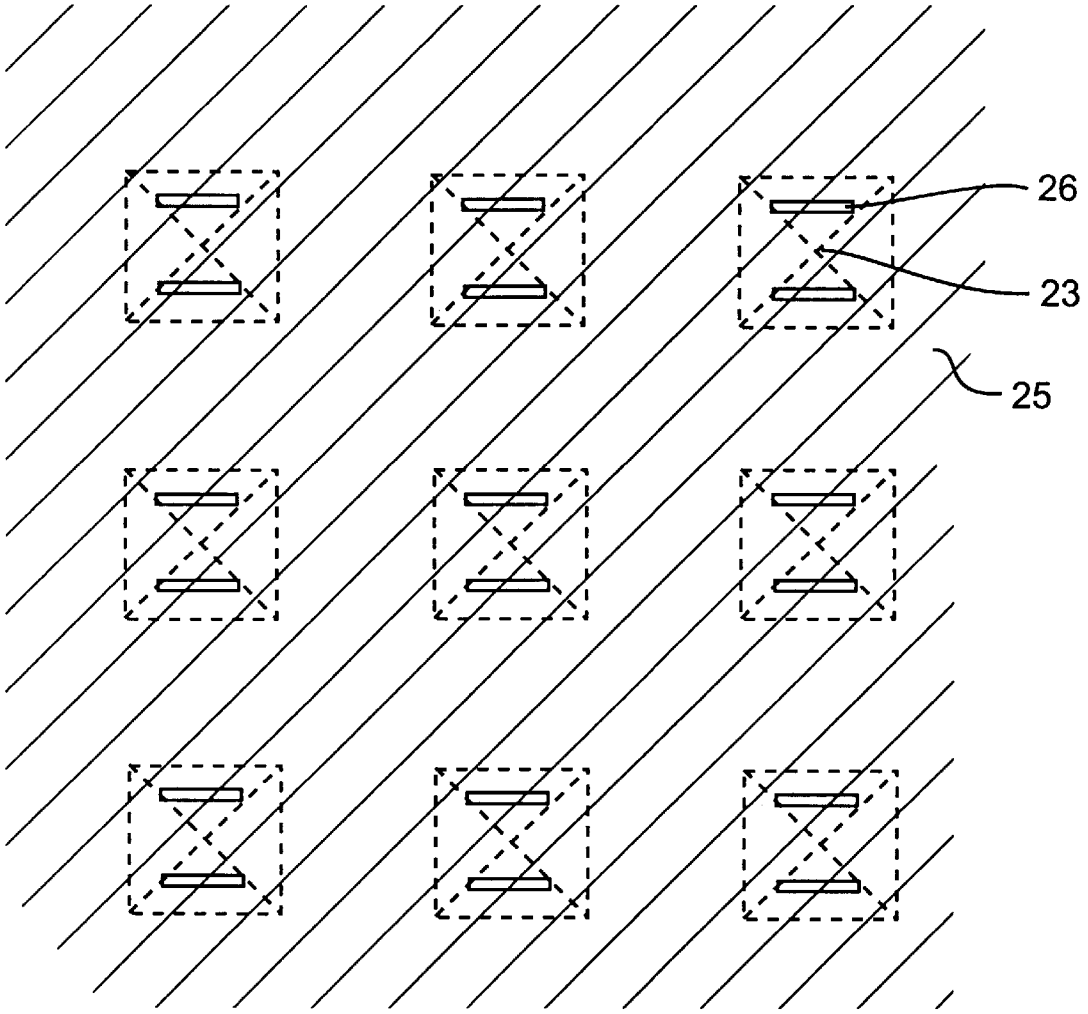
FIG. 14 is a plan view of a micro vacuum tube in accordance with a twelfth embodiment of the present invention.

Throughhole 26 is preferably not right above the tip of protuberance 20 so as to protect the tip from etching. For example, the distribution of throughhole 26 is shown in FIG. 14, which is a plane view of a micro vacuum tube of the embodiment of the present invention. Anode electrode layer 25 provides throughholes 26 at both sides of each tips of protuberances 20.

According to this embodiment, a micro vacuum tube could provide an anode, an emitter, and a gate as a single body.

Figure 15A:
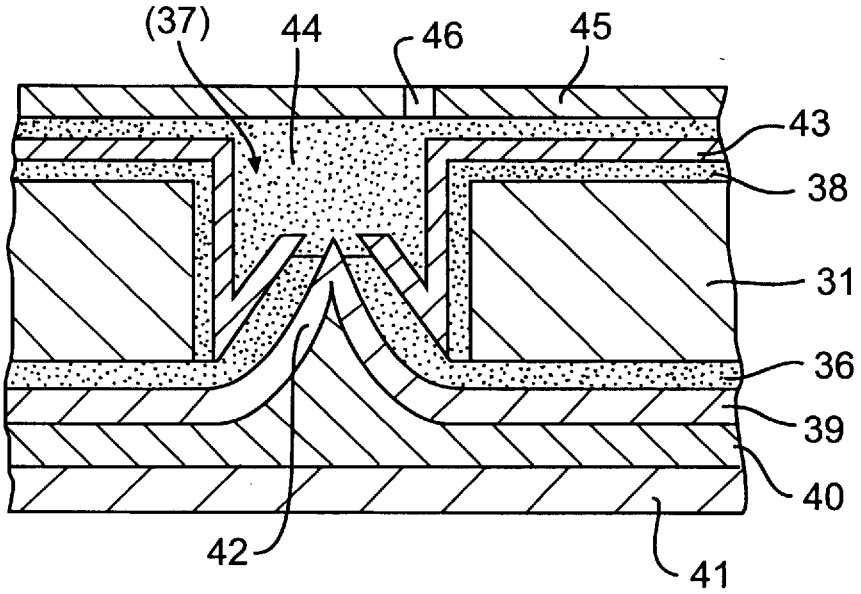
FIGS. 15(*a*) and (*b*) are cross-sectional views of a micro vacuum tube in accordance with a thirteenth embodiment of the present invention.
Figure 15B:
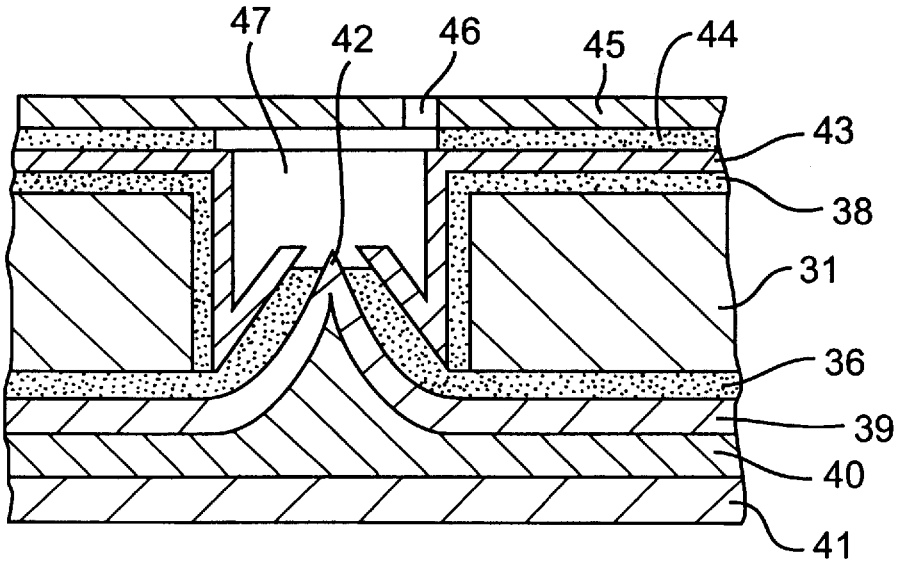

FIGS. 15(*a*) and (*b*) show cross-sectional views of a micro vacuum tube of yet another embodiment using the cold emitter of FIG. 9(*i*) according to the present invention. In this case, the same method could be used as FIGS. 13 (*a*) and (*b*). A cold emitter shown in FIG. 9(*i*) is used in this embodiment.

A removable insulator layer 44 is deposited on gate electrode layer 43 so as to fill hole 37. Anode electrode layer 45 is deposited on removable insulator layer 24.

Anode electrode layer 45 provides a throughhole 46 above protuberance 42 and therefore above hole 37. The throughhole 46 however, is not right above the tip of protuberance 42 (FIG. 15(*a*)). Removal insulator layer 43 is partially removed through throughhole 46 so as to make a space 47 between anode electrode layer 46 and the tip of protuberance 42 (FIG. 15(*b*)).

It will be apparent to those skilled in the art that various modifications and variations can be made in the micro vacuum tube of the present invention without departing from the spirit or scope of the invention. Thus, it is intended that the present invention cover the modifications and variations of this invention provided they come within the scope of the appended claims and their equivalents.

What is claimed is:

1. A microelectronic device comprising:

a conductive layer;

a core layer formed on the conductive layer and having at least one outward protuberance on a surface opposite of the conductive layer; and an emitter layer formed on the core layer to cover at least a top portion of the outward protuberance, the material of the core layer having a larger electrical resistance than that of the material of the emitter layer;

wherein the top portion of the outward protuberance culminates to a tip and a portion of the emitter layer formed on the protuberance culminates to a tip.

2. The device according to claim 1, further comprising a gate electrode layer formed above the emitter layer having an opening around the portion of the emitter layer formed on the top portion of the protuberance, thereby exposing the tip of the portion of the emitter layer.

3. The device according to claim 2, further comprising an insulating layer formed between the gate electrode layer and the emitter layer.

4. The device according to claim 1, further comprising an anode electrode disposed above the tip of the emitter layer, wherein a gap is formed between the anode electrode and the tip of the emitter layer.

5. The device according to claim 4, wherein the anode electrode comprises a phosphor layer.

6. The device according to claim 1, further comprising a gate electrode formed above the emitter layer having an opening around the portion of the emitter layer formed on the top portion of the protuberance, thereby exposing the tip of the emitter layer.

7. The device according to claim 6, wherein a vacuum is disposed within the gap.

8. The device according to claim 1, wherein the core layer includes a material having a smaller inner stress than that of a material of the emitter layer.

9. The device according to claim 1, wherein the core layer includes a material stronger than a material of the emitter layer.

10. The device according to claim 1, wherein the protuberance has a pyramidical shape.

11. The device according to claim 1, wherein the emitter layer has a thickness less than the thickness of the core layer within the protuberance.

12. The device according to claim 1, wherein the emitter layer is divided into a plurality of cold emitters.

13. The device according to claim 1, wherein the emitter layer is divided into plural groups of cold emitters.

14. The device according to claim 1, wherein a plurality of cold emitters are provided in parallel connection.

15. A micro vacuum tube, comprising:

a substrate;

a conductive layer formed on the substrate;

a core layer formed on the conductive layer and having at least one outward protuberance on a surface opposite of the conductive layer;

an emitter layer formed on the core layer to cover at least a top portion of the outward protuberance, wherein the top portion of the outward protuberance culminates to a tip and a portion of the emitter layer formed on the protuberance culminates to a tip and wherein a material of the core layer has a larger electrical resistance than that of a material of the emitter layer;

a gate electrode layer, formed above the core layer, having an opening around the portion of the emitter layer formed on the top portion of the protuberance, thereby exposing the tip of the emitter layer;

an anode electrode disposed above the tip of the emitter layer; and a spacer disposed between the substrate and the anode electrode to create a gap between the anode electrode and the tip of the emitter layer.

16. The micro vacuum tube according to claim 15, further comprising an insulating layer formed between the gate electrode layer and the emitter layer.

* * * * *